United States Patent [19]

Paradis et al.

[11] 4,344,549

[45] Aug. 17, 1982

[54] CLOSE FITTINGS FOR FRANGIBLE OBJECTS

[75] Inventors: Joseph R. Paradis, Holden; Edward W. Kaleskas, Jefferson, both of Mass.

[73] Assignee: Nypro Inc., Clinton, Mass.

[21] Appl. No.: 153,756

[22] Filed: May 27, 1980

[51] Int. Cl.[3] ..... A47G 19/14

[52] U.S. Cl. ..... 222/465 A; 222/568

[58] Field of Search ..... 222/465, 475, 568, 570

[56] References Cited

U.S. PATENT DOCUMENTS

| | | | |
|---|---|---|---|
| 3,154,227 | 10/1964 | Anderson et al. | 222/465 X |
| 3,400,865 | 9/1968 | Hester | 222/475 |
| 3,606,102 | 9/1971 | Lowry et al. | 222/570 X |

*Primary Examiner*—David A. Scherbel

*Attorney, Agent, or Firm*—George E. Kersey

[57] ABSTRACT

Close fittings for frangible objects such as glass decanters provided by a collar which can include a pouring spout and handle. The collar is positioned on the rim of the decanter against a gasket which is drawn into compressional engagement with the rim, without any substantial transverse movement that could damage the decanter, by threading a member into the collar. The decanter and the threading member include mating inclined surfaces which facilitate the compressional movement of the gasket into close contact with the rim as the member is threaded into the collar.

18 Claims, 7 Drawing Figures

CLOSE FITTINGS FOR FRANGIBLE OBJECTS

BACKGROUND OF THE INVENTION

This invention relates to close fittings for frangible objects, and, more particularly, to closely fitting pouring spouts for glass decanters.

Fittings are often used to protect frangible objects, as well as to serve as an outlet or reinforcement for the object. In many cases the fitting should be tightly secured to the object to prevent leakage.

An example is the decanter for dispensing liquids such as coffee and tea. Decanters are commonly made of glass, with a body portion that extends to a neck. When the decanter is to be used, it is tilted to an appropriate position to allow its contents to be poured into another container. The fitting for such a decanter has a handle that allows the user to properly position the decanter for pouring. Originally the handle was attached to an annular band on the neck of the decanter. This arrangement had the disadvantage that the pouring spout of the decanter was an integral part of the glass unit and was subject to breakage.

It was recognized early that the pouring spout could be of a more durable material than glass and that it should be part of the handle. At first the combination pouring spout and handle was affixed by clamping. But the clamped attachment of a pouring spout is time consuming and costly. It often fails to provide a secure fit between the decanter and the pouring spout. And even when the spout is clamped tightly during manufacture of the decanter, it tends to become loose during usage.

A number of attempts have been made to achieve a unitary handle and pouring spout combination which could be securely affixed to a decanter without clamping. In U.S. Pat. Nos. 3,615,045; 4,104,251; and 4,140,252 a unitary pouring spout is force-fitted onto a neck of a glass receptacle with a flexible gasket. Assembly is difficult and results in a number of broken decanters. It is particularly true when the gasket grips the pouring spout and makes it difficult to manipulate. Furthermore, if the tolerances required to obtain a tight fit are not met, a loose and therefore leaky seal results. The tall neck that is required also produces difficulties.

A further attempt to provide a decanter with a unitary pouring spout bonded to a rigid glass receptacle is disclosed in U.S. Pat. No. 4,090,648. A pouring spout is formed with an annular cavity shaped to receive the neck portion of a rigid glass decanter. Flexible adhesive material is applied in a liquid state to the annular cavity in the rigid receptacle substantially filling the channel. Thereafter the neck portion of the rigid receptacle is inserted into the channel so that the flexible adhesive completely fills the void and surrounds the inserted neck. When solid the flexible material forms a permanent sealing bond between the receptacle and the pouring spout. This procedure has the disadvantage that the flexible adhesive material can be affected by heat and result in loosening of the bond between the pouring spout and the receptacle. In addition there is a substantial amount of breakage of the receptacles during fabrication. The adhesive materials also are difficult to apply and costly.

Another attempt has been to use a unitary pouring structure that is affixed to the glass receptacle using an epoxy resin. The epoxy forms a rigid seal between the pouring spout and the glass receptacle, which can break during shipment. In addition, the epoxy resins do not adhere well to the usual spout materials allowing the seal between the spout and the glass to be readily broken and cause fluid leakage.

Other fittings of the prior art are to be found in the following U.S. Pat. Nos. 2,982,451; 2,993,629; 3,606,102; 3,491,924; 3,615,045; and U.S. Pat. No. Re. 29,708.

Accordingly, it is an object of the invention to facilitate the provision of close fittings for frangible objects. A related object is to achieve close fittings with reduced danger of breakage of frangible objects. Another related object is to facilitate the provision of the closely fitting pouring spouts for glass decanters.

Another object of the invention is to provide a durable fitting that can serve as a pouring spout for a frangible container without the need for clamped spouts or handles while achieving the secure attachment of the fitting to the object. A related object is to avoid any loosening of the spout from the fitting or of the fitting from the object to which it is attached, during usage.

Still another object of the invention is to achieve a unitary handle and pouring spout combination which can be securely affixed to a decanter without clamping. A related object is to achieve simplified assembly and a reduction in the number of broken decanters.

Yet another object of the invention is to simplify the assembly, and reduce breakage, in decanters which make use of a gasket that grips the pouring spout. A related object is to facilitate the manipulation of seating gaskets used in decanters which embody pouring spouts. Another related object is to achieve a tight seal with containers that have a comparatively wide range of tolerances so that leaky seals can be avoided.

A further object of the invention is to achieve a decanter with a unitary pouring spout that is suitably bonded to a glass receptacle. A related object is to avoid the need for adhesive material in securing a suitable bond of a spout to a glass receptacle. Another related object is to avoid the use of resins in seeking to achieve a secure fit of a pouring spout to a glass receptacle.

SUMMARY OF THE INVENTION

In accomplishing the foregoing and related objects, the invention provides a fitting which includes a collar for a frangible object. The collar has interior screw threads and receives an insertable member with exterior screw threads. A gasket is included between the collar and the object. This gasket is drawn tightly against the object by the threading of the member into the collar, the threads of which intermesh. The result of the threading is that the gasket becomes compressed against the object without any substantial lateral movement of the gasket relative to the object. Consequently a secure seal is achieved between the gasket and the object with reduced chance of breakage.

In accordance with one aspect of the invention, the collar includes a pouring spout and handle. The pouring spout and handle are advantageously integrated with the collar. The resultant unitary combination is desirably of a high impact resistance plastic material such as polypropylene.

In accordance with another aspect of the invention, the frangible object is a glass decanter and the collar is positioned agains a rim of the decanter with the gasket in between. The fitting is advantageously a split ring with sufficient flexibility that it can be inserted between the object, e.g. glass decanter, and the collar. The decanter advantageously has an inclined neck and the member has a tapered inner wall which engages the neck. In addition the member desirably includes flexible ribs, which join the inner wall of the member to an outer wall that engages the collar.

In accordance with a further aspect of the invention, the gasket positioned between the object and the collar is annular. It desirably seats into a recess of the collar and bears against the rim of the object. The recess is advantageously of a V-shaped configuration, but other configurations may be employed as well.

In accordance with yet another aspect of the invention, the threading member includes recesses to facilitate the threading operation. The recesses may be on a side surface of the threading member or on the bottom portion. The threading can be accomplished by using a spanner device which engages the recesses. The spanner desirably contacts oppositely positioned recesses on the threading member.

In accordance with a still further aspect of the invention, the gasket is positioned between the collar and a rim of a frangible glass decanter. The gasket is compressed against the rim without movement relative to the circumference to provide a tight seal between the collar and the rim of the decanter notwithstanding a relatively wide range of tolerance variations that result from conventional commercial production of glass decanters. The decanter is desirably provided with a tapered neck and the threading member bears against the neck during the application of the compressional force that brings the gasket into close engagement with the rim of the decanter without any substantial danger of breakage.

DESCRIPTION OF THE DRAWINGS

Other aspects of the invention will become apparent after considering several illustrative embodiments, taken in conjunction with the drawings in which.

DETAILED DESCRIPTION

Figure 1:
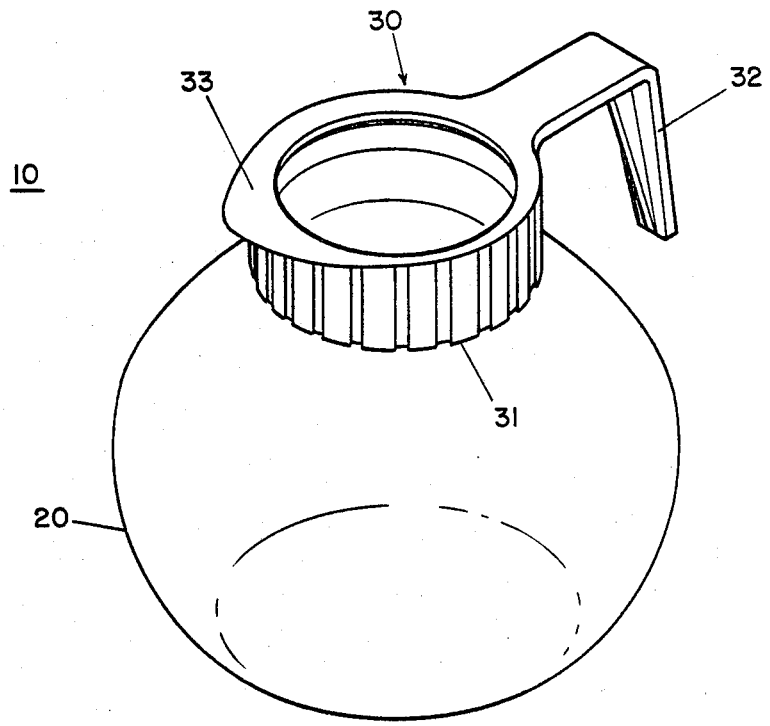
FIG. 1 is a perspective view of a glass decanter containing a closely positioned, pouring spout fitting in accordance with the invention.

With reference to the drawings, FIG. 1 shows an assemblage 10 in the form of a glass bowl 20 with a close fitting pouring spout 30. The spout 30 includes a collar 31 with an integral handle 32 and a pouring lip 33.

Figure 2A:
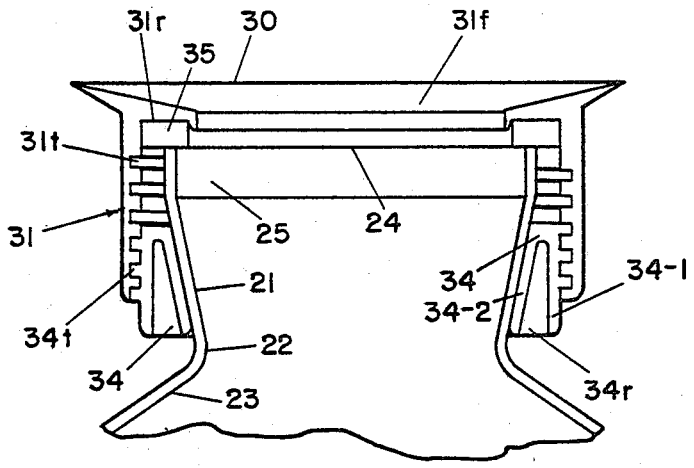
FIG. 2A is a sectional view of the upper portion of the fitting-decanter combination of FIG. 1.

As shown in FIG. 2A, the bowl 20 includes a neck 21 with a constriction 22 at the junction of the neck 21 with the upper portion 23 of the bowl 20. The neck 21 in turn extends to a lip 24 over a cylindrical extension 25. The fitting 30 includes in addition to the collar 31, a member 34 and a gasket 35. As can be seen in FIG. 2A, the collar 31 includes inner threads **31*t* while the member 34 includes outer threads 34*t*. Ribs 34*r* join the outer wall 34-1 to the inner wall 34-2 of the member 34**.

Figure 3:
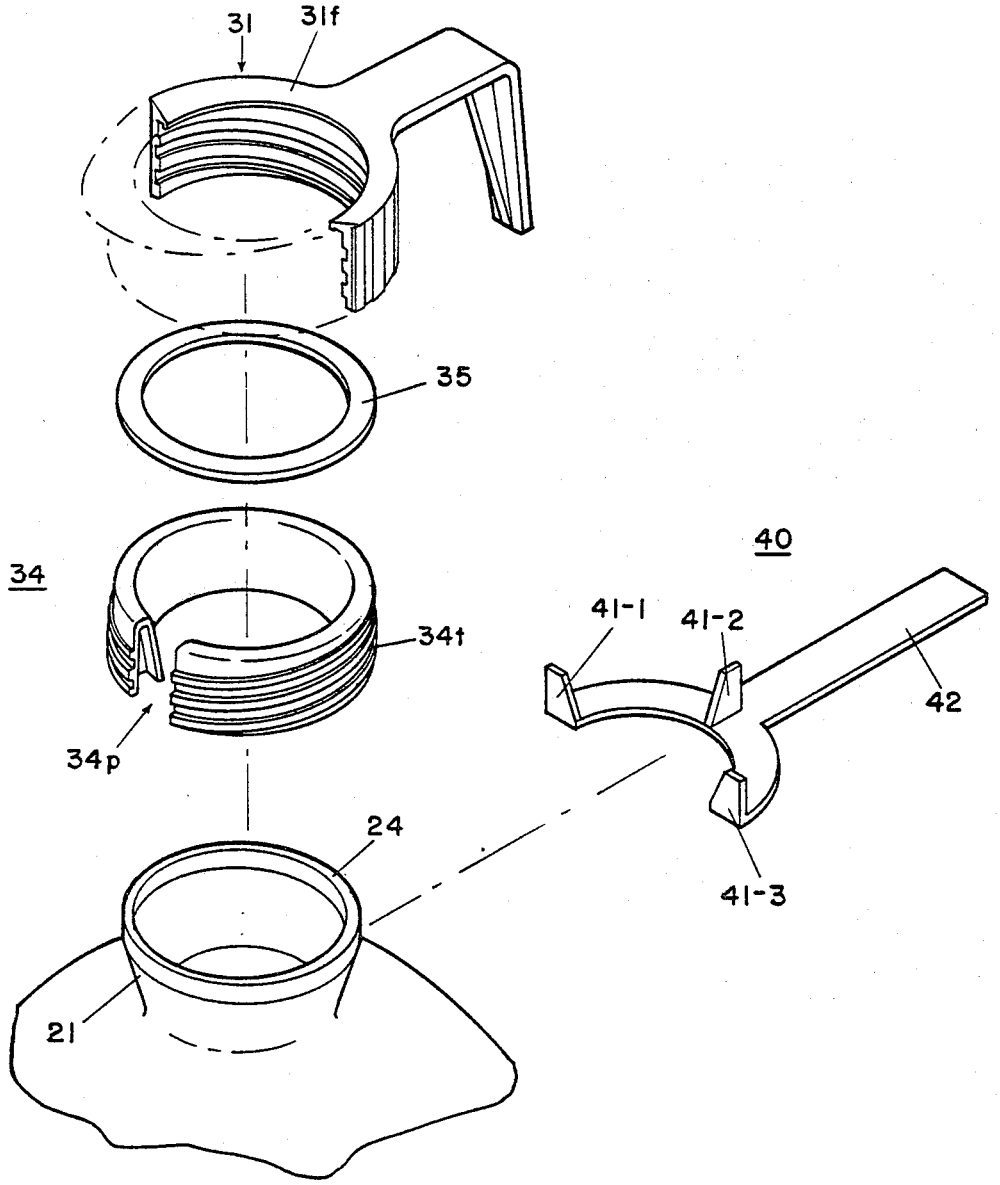
FIG. 3 is an exploded view of the components making up the close fitting pouring spout of FIG. 1, including a spanner device used in achieving the desired fitting without breakage of the associated decanter.

The way in which the collar 31 is assembled to the neck 21 of the bowl 20 is illustrated in FIG. 3, which shows the component parts of the fitting 30 in exploded form in the order of assemblage upon the neck 21 of the bowl 20. Accordingly, the member 34 which is in the form of a split ring with an opening **34*p* is first mounted on the neck by being spread apart sufficiently at the opening 34*p* until it clears the rim 24 and the circular extension 25. For that purpose the member 34 is fabricated from a material which has sufficient flexibility of permit spreading and placement on a neck 21**. A suitable material is plastic of the polypropylene type. It will be appreciated that other plastics may be used, as well as other materials such as metals, including iron, steel, copper and the like.

Once the split member 34 is positioned on the neck 21, the gasket 35 is placed overlying the upper surface of the rim 24. The gasket is of any suitable compressionable material which can provide a seal between the lip 24 and the collar 31. Suitable elastomeric materials for the gasket 35 include rubber.

With the split member 34 in place on the neck 21 and the gasket 35 in place on the rim 24, the next step is to position the collar 31 on the neck so that it comes into contact with the threads **34*t* of the member 34. If contact is achieved without simultaneous contact with the gasket 35, the collar 31 can be threaded on the member 34 until resistance from the gasket is reached. In general practice however, it is preferable, once there is contact between the lowermost thread of the collar 31 and the uppermost thread of the member 34, to then thread the member 34 into the collar 31, causing the flange portion 31*f* of the collar 31 to compress the gasket 35 against the lip 24. Since the collar 31 is stationary during the threading of the member 34 into it, there is no lateral force applied to the gasket which could cause possible damage to the gasket or to the bowl 20**.

Figure 2B:
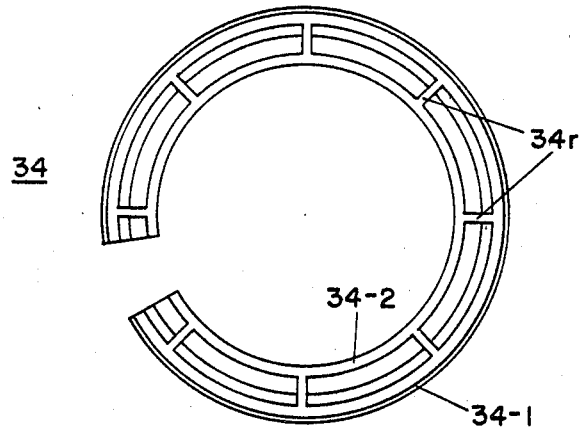
FIG. 2B is a view from the bottom of the pouring spout fitting of FIG. 2A.

In the embodiment of the invention shown in FIG. 3, the split member 34, in bottom view, is as shown in FIG. 2B, with a set of ribs **34*r* spaced between an inner wall 34-2 and an outer wall 34-1. The side surfaces of the rib 34*r* provide an appropriate location for the insertion of a tool, such as the spanner 40 shown in FIG. 3. The spanner includes a set of prongs 41-1 41-2 and 41-3 which are able to engage side surfaces of the ribs 34*r*. The member 34 is therefore easily threaded into the collar 31, which is held stationary, by simply engaging the prongs 41-1 through 41-3 against appropriate ribs 34*r* on the underside of the member 34 and rotating the handle 42 of the tool 40 in the appropriate clockwise or counterclockwise according to the sense of the threads 34*t***.

During the threading operation, as indicated in FIG. 2A, the inner wall 34-2 of the member 34 bears against the mating inclined wall of the neck 21 and the gasket 35 is drawn snugly and securely against the rim 24. The result is the composite bowl-spout assembly 10 of FIG. 1.

As indicated in FIG. 2A the flange **31*f* of the collar 31 includes a recess 31*r*. The illustrative recess 31*r* of FIG. 2A has a substantially rectangular cross section with a lip curving away from the associated gasket at the interior circumference of the collar 31. This design applies suitable compressional forces to the gasket 35** during the threading operation discussed above.

It is to be noted that since the gasket 35 is not subjected to circumferential forces during the threading operation there is a reduced chance of breakage. This is accompanied by the secure seal that is provided by the compressional forces which can, as a result, compensate for wide irregularities in the upper surface of the rim 24. Similarly the circumferential extension 25 as well as the neck 21 can permit a wide range of tolerances without detriment to the invention. The result is a low cost, efficient and speedy technique for securely attaching a fitting, such as a pouring spout, to a frangible object, such as a glass decanter.

Figure 4A:
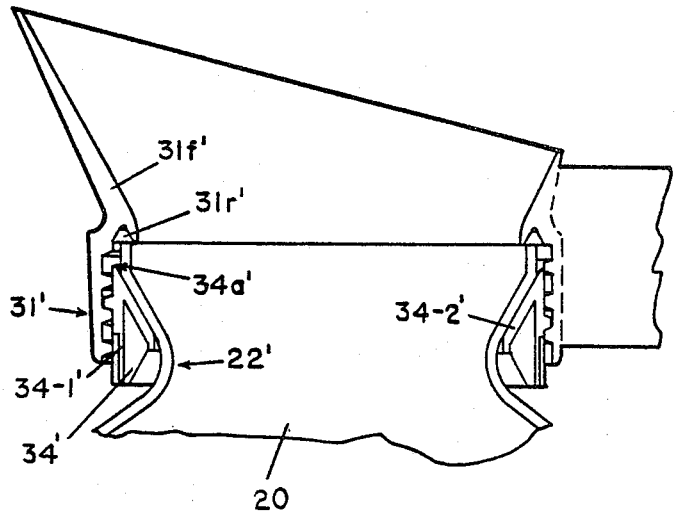
FIG. 4A is a sectional view of the upper portion of a pouring spout decanter combination in accordance with the invention.
Figure 4B:
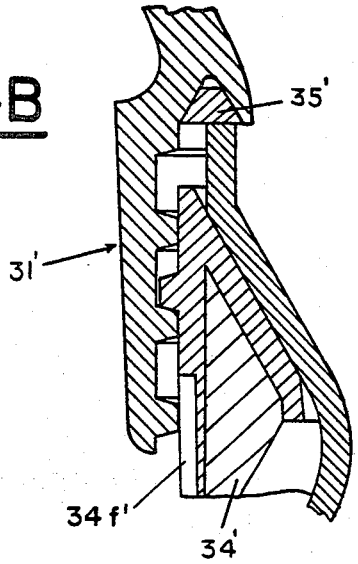
FIG. 4B is an enlargement of a portion of the spout decanter combination of FIG. 4A illustrating the secure seal achieved in accordance with the invention.
Figure 5:
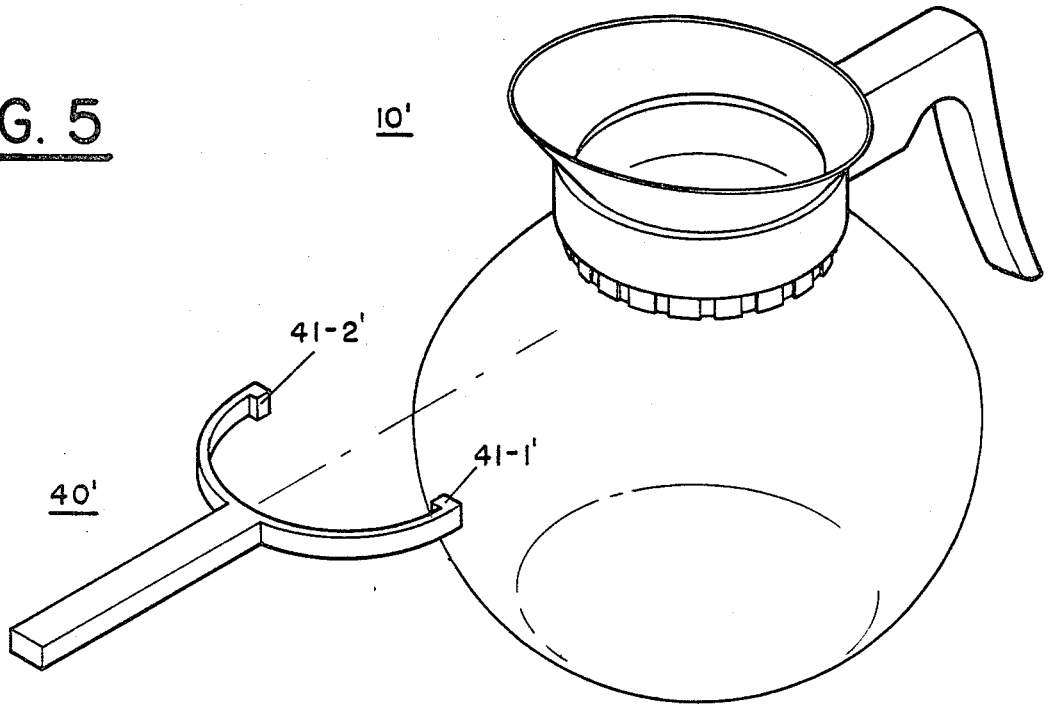
FIG. 5 is a perspective view showing the resultant assembly of the fitting of FIGS. 4A and 4B on a glass decanter, including a spanner wrench that is used in securing the fitting to the decanter.

An alternative embodiment of the invention is illustrated in FIGS. 4A, 4B and 5. In this embodiment a collar 31' is provided with a flange **31*f'* having a recess 31*r'* with a substantially triangular cross section. The member 34' which threads into the collar 31' has an outer wall 34-1' which converges with an inner wall 34-2' at an apex 34*a'*. The apex 34*a'* facilitates contact of the collar 31' with the member 34'. In addition, for the embodiment of FIG. 4A the upper portion of the decanter 20 includes a constriction 22' which is a substantially symmetrical arc about its valley point. This permits a resultant composite assemblage 10' as shown in FIG. 5 in which the fitting 31' appears more closely integrated into the resulting structure. Details of the interrelation among the gasket 35', which has a trapezoidal cross section in order to be suitably received by the triangular recess 31*r'* of the flange 31*f'*, with the collar 31' and the member 34', are shown in FIG. 4B. By contrast with the member 34 of FIG. 2A, the member 34' of FIG. 4B has a set of flutings 34*f'* on the outside wall 34-1'. These flutings are readily used to secure the collar 31' to the bowl 20' of FIG. 5. For that purpose a spanner 40' may be used having opposed grippers 41-1' and 41-2'. The spanner 40' is then used by having its grippers 41-1' and 41-2' engage appropriate ones of the flutings 34*f'* followed by rotation movement to thread the member 34' into the collar 31' and produce the result shown in FIGS. 4A and 4B**.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A fitting for a frangible object having an inclined neck having an outer rim extending directly from said object, comprising:

a collar for the neck of said object, said collar having interior screw threads;

a split-ring member engageable with said collar and threadable thereinto, said split ring member having a tapered inner wall which is complementary to said inclined neck;

and a gasket between said collar and said rim of said neck of said object which is drawn tightly against said neck by the threading of said member into said collar;

thereby to provide a close fitting for said frangible object with reduced danger of breakage.

2. A fitting in accordance with claim 1 wherein said collar includes a pouring spout and a handle.

3. A fitting in accordance with claim 2 wherein said pouring spout and handle are integral with said collar.

4. A fitting in accordance with claim 1 wherein said frangible object is a glass decanter and said collar is positioned against a rim thereof.

5. A fitting in accordance with claim 1 wherein said member has an outer wall and a tapered inner wall.

6. A fitting in accordance with claim 1 wherein said member includes flexible ribs.

7. A fitting in accordance with claim 6 wherein said member has an outer wall and an inner wall and said flexible ribs join said outer wall to said inner wall.

8. A fitting in accordance with claim 1 wherein said frangible object is a glass decanter and said member is positioned to bear against a neck thereof.

9. A fitting in accordance with claim 1 wherein said gasket is annular and is positioned between a flange of said collar and said rim of said frangible object.

10. A fitting in accordance with claim 9 wherein said gasket fits into a recess of said collar.

11. A fitting in accordance with claim 10 wherein said recess is V-shaped.

12. A fitting in accordance with claim 1 wherein said member includes recesses to facilitate the threading thereof into said collar.

13. A fitting in accordance with claim 12 wherein said recesses are on a side surface of said member.

14. A fitting in accordance with claim 12 wherein said recesses are on a bottom of said member.

15. A fitting in accordance with claim 1 wherein said member is threaded into said collar to compress said gasket against said frangible object by a spanner device which engages diverse parts of said member.

16. A fitting in accordance with claim 10 wherein said spanner engages opposite positions on said member.

17. A fitting in accordance with claim 1 wherein said gasket is positioned between said collar and said rim of said frangible object and is compressed against said rim without movement relative to the circumference thereof; thereby to provide a tight seal between said collar and said rim without substantial danger of breakage of said frangible object.

18. A fitting in accordance with claim 17 wherein said frangible object is a glass decanter with a tapered neck and said member bears there against during the application of compressional force to said gasket to bring it into close engagement with said rim of said object.

* * * * *